US009890663B2

(12) United States Patent
Scott

(10) Patent No.: US 9,890,663 B2
(45) Date of Patent: Feb. 13, 2018

(54) TURBINE EXHAUST CASE MULTI-PIECE FRAME

(71) Applicant: United Technologies Corporation, Hartford, CT (US)

(72) Inventor: Jonathan Ariel Scott, Southington, CT (US)

(73) Assignee: United Technologies Corporation, Farmington, CT (US)

( * ) Notice: Subject to any disclaimer, the term of this patent is extended or adjusted under 35 U.S.C. 154(b) by 304 days.

(21) Appl. No.: 14/758,275

(22) PCT Filed: Dec. 20, 2013

(86) PCT No.: PCT/US2013/076872

§ 371 (c)(1),
(2) Date: Jun. 29, 2015

(87) PCT Pub. No.: WO2014/105688

PCT Pub. Date: Jul. 3, 2014

(65) Prior Publication Data

US 2015/0354413 A1 Dec. 10, 2015

Related U.S. Application Data

(60) Provisional application No. 61/747,817, filed on Dec. 31, 2012.

(51) Int. Cl.
*F01D 25/16* (2006.01)
*F01D 25/30* (2006.01)
(Continued)

(52) U.S. Cl.
CPC ..... *F01D 25/30* (2013.01); *F01D 1/18* (2013.01); *F01D 25/162* (2013.01); *F01D 25/24* (2013.01);
(Continued)

(58) Field of Classification Search
CPC ..... F01D 25/30; F01D 1/18; F01D 25/162; F01D 25/24; F01D 25/243
(Continued)

(56) References Cited

U.S. PATENT DOCUMENTS 2,214,108 A 7/1938 Grece
3,576,328 A 4/1971 Vose
(Continued)

FOREIGN PATENT DOCUMENTS

WO WO 03/020469 A1 3/2003
WO WO 2006/007686 A1 1/2006
(Continued)

OTHER PUBLICATIONS

International Search Report and Written Opinion for PCT Application Serial No. PCT/US2013/076872, dated May 13, 2014, 14 pages.
(Continued)

*Primary Examiner* — Richard Edgar
(74) *Attorney, Agent, or Firm* — Kinney & Lange, P.A.

(57) ABSTRACT

A turbine exhaust case (28) comprises a fairing (120) defining an airflow path through the turbine exhaust case, and a multi-piece frame (100) disposed through and around the fairing to support a bearing load. The multi-piece frame comprises an inner ring (104), an outer ring (102), and a plurality of strut bosses (106). The outer ring is disposed concentrically outward of the inner ring, and has open bosses (126) at strut locations. The plurality of radial struts pass through the vane fairing, are secured to the inner ring via radial fasteners (108), and are secured via non-radial fasteners (114) to the open boss.

15 Claims, 3 Drawing Sheets

(51) Int. Cl.
*F01D 1/18* (2006.01)
*F01D 25/24* (2006.01)

(52) U.S. Cl.
CPC ..... *F01D 25/243* (2013.01); *Y10T 29/49323* (2015.01)

(58) Field of Classification Search
USPC ..... 415/200
See application file for complete search history.

(56) References Cited

U.S. PATENT DOCUMENTS 3,710,674 A 1/1973 Tabor
3,802,046 A 4/1974 Wachtell et al.
3,877,762 A 4/1975 Dennison
3,970,319 A 7/1976 Carroll et al.
4,009,569 A 3/1977 Kozlin
4,044,555 A 4/1977 McLoughlin et al.
4,088,422 A 5/1978 Martin
4,114,248 A 9/1978 Smith et al.
4,305,697 A 12/1981 Cohen et al.
4,321,007 A 3/1982 Dennison et al.
4,369,016 A 1/1983 Dennison
4,478,551 A 10/1984 Honeycutt, Jr. et al.
4,645,217 A 2/1987 Honeycutt, Jr. et al.
4,678,113 A 7/1987 Bridges et al.
4,738,453 A 4/1988 Ide
4,756,536 A 7/1988 Belcher
4,793,770 A 12/1988 Schonewald et al.
4,920,742 A 5/1990 Nash et al.
4,979,872 A * 12/1990 Myers ..... F01D 9/065 403/131
4,987,736 A 1/1991 Ciokajlo et al.
4,989,406 A 2/1991 Vdoviak et al.
4,993,918 A 2/1991 Myers et al.
5,031,922 A 7/1991 Heydrich
5,042,823 A 8/1991 Mackay et al.
5,071,138 A 12/1991 Mackay et al.
5,076,049 A 12/1991 VonBenken et al.
5,100,158 A 3/1992 Gardner
5,108,116 A 4/1992 Johnson et al.
5,169,159 A 12/1992 Pope et al.
5,174,584 A 12/1992 Lahrman
5,188,507 A 2/1993 Sweeney
5,211,541 A 5/1993 Fledderjohn et al.
5,236,302 A 8/1993 Weisgerber et al.
5,246,295 A 9/1993 Ide
5,265,807 A 11/1993 Steckbeck et al.
5,269,057 A 12/1993 Mendham
5,272,869 A 12/1993 Dawson et al.
5,273,397 A 12/1993 Czachor et al.
5,292,227 A 3/1994 Czachor et al.
5,312,227 A 5/1994 Grateau et al.
5,338,154 A 8/1994 Meade et al.
5,357,744 A 10/1994 Czachor et al.
5,370,402 A 12/1994 Gardner et al.
5,385,409 A 1/1995 Ide
5,401,036 A 3/1995 Basu
5,438,756 A 8/1995 Halchak et al.
5,441,385 A * 8/1995 Boyd ..... F01D 25/246 415/209.2
5,474,305 A 12/1995 Flower
5,483,792 A 1/1996 Czachor et al.
5,558,341 A 9/1996 McNickle et al.
5,597,286 A 1/1997 Dawson et al.
5,605,438 A 2/1997 Burdgick et al.
5,609,467 A 3/1997 Lenhart et al.
5,632,493 A 5/1997 Gardner
5,634,767 A 6/1997 Dawson
5,691,279 A 11/1997 Tauber et al.
5,755,445 A 5/1998 Arora
5,851,105 A 12/1998 Fric et al.
5,911,400 A 6/1999 Niethammer et al.
6,163,959 A 12/2000 Arraitz et al.
6,196,550 B1 3/2001 Arora et al.
6,227,800 B1 5/2001 Spring et al.
6,337,751 B1 1/2002 Kimizuka
6,343,912 B1 2/2002 Mangeiga et al.
6,358,001 B1 3/2002 Bosel et al.
6,364,316 B1 4/2002 Arora
6,439,841 B1 8/2002 Bosel
6,511,284 B2 1/2003 Darnell et al.
6,578,363 B2 6/2003 Hashimoto et al.
6,601,853 B2 8/2003 Inoue
6,612,807 B2 9/2003 Czachor
6,619,030 B1 9/2003 Seda et al.
6,638,013 B2 10/2003 Nguyen et al.
6,652,229 B2 11/2003 Lu
6,672,833 B2 1/2004 MacLean et al.
6,719,524 B2 4/2004 Nguyen et al.
6,736,401 B2 5/2004 Chung et al.
6,792,758 B2 9/2004 Dowman
6,796,765 B2 9/2004 Kosel et al.
6,805,356 B2 10/2004 Inoue
6,811,154 B2 11/2004 Proctor et al.
6,935,631 B2 8/2005 Inoue
6,969,826 B2 11/2005 Trewiler et al.
6,983,608 B2 1/2006 Allen, Jr. et al.
7,055,305 B2 6/2006 Baxter et al.
7,094,026 B2 8/2006 Coign et al.
7,100,358 B2 9/2006 Gekht et al.
7,200,933 B2 4/2007 Lundgren et al.
7,229,249 B2 6/2007 Durocher et al.
7,238,008 B2 7/2007 Bobo et al.
7,367,567 B2 5/2008 Farah et al.
7,371,044 B2 5/2008 Nereim
7,389,583 B2 6/2008 Lundgren
7,614,150 B2 11/2009 Lundgren
7,631,879 B2 12/2009 Diantonio
7,673,461 B2 3/2010 Cameriano et al.
7,677,047 B2 3/2010 Somanath et al.
7,735,833 B2 6/2010 Braun et al.
7,797,922 B2 * 9/2010 Eleftheriou ..... F01D 25/162 415/208.4
7,798,768 B2 9/2010 Strain et al.
7,815,417 B2 10/2010 Somanath et al.
7,824,152 B2 11/2010 Morrison
7,891,165 B2 2/2011 Bader et al.
7,909,573 B2 3/2011 Cameriano et al.
7,955,446 B2 6/2011 Dierberger
7,959,409 B2 6/2011 Guo et al.
7,988,799 B2 8/2011 Dierberger
8,069,648 B2 12/2011 Snyder et al.
8,083,465 B2 12/2011 Herbst et al.
8,091,371 B2 1/2012 Durocher et al.
8,092,161 B2 1/2012 Cai et al.
8,152,451 B2 4/2012 Manteiga et al.
8,162,593 B2 4/2012 Guimbard et al.
8,172,526 B2 5/2012 Lescure et al.
8,177,488 B2 5/2012 Manteiga et al.
8,221,071 B2 7/2012 Wojno et al.
8,245,399 B2 8/2012 Anantharaman et al.
8,245,518 B2 8/2012 Durocher et al.
8,282,342 B2 10/2012 Tonks et al.
8,371,127 B2 2/2013 Durocher et al.
8,371,812 B2 2/2013 Manteiga et al.
2003/0025274 A1 2/2003 Allan et al.
2003/0042682 A1 3/2003 Inoue
2003/0062684 A1 4/2003 Inoue
2003/0062685 A1 4/2003 Inoue
2005/0046113 A1 3/2005 Inoue
2006/0010852 A1 1/2006 Gekht et al.
2008/0216300 A1 9/2008 Anderson et al.
2010/0132370 A1 6/2010 Durocher et al.
2010/0132371 A1 6/2010 Durocher et al.
2010/0132373 A1 6/2010 Durocher et al.
2010/0132374 A1 6/2010 Manteiga et al.
2010/0132376 A1 6/2010 Durocher et al.
2010/0132377 A1 6/2010 Durocher et al.
2010/0202872 A1 8/2010 Weidmann
2010/0236244 A1 9/2010 Longardner
2010/0275572 A1 11/2010 Durocher et al.
2010/0275614 A1 11/2010 Fontaine et al.
2010/0303608 A1 12/2010 Kataoka et al.

(56) References Cited

U.S. PATENT DOCUMENTS

| | | | |
|---|---|---|---|
| 2010/0307165 | A1 | 12/2010 | Wong et al. |
| 2011/0000223 | A1 | 1/2011 | Russberg |
| 2011/0005234 | A1 | 1/2011 | Hashimoto et al. |
| 2011/0061767 | A1 | 3/2011 | Vontell et al. |
| 2011/0081239 | A1 | 4/2011 | Durocher |
| 2011/0081240 | A1 | 4/2011 | Durocher et al. |
| 2011/0085895 | A1 | 4/2011 | Durocher et al. |
| 2011/0214433 | A1 | 9/2011 | Feindel et al. |
| 2011/0262277 | A1 | 10/2011 | Sjoqvist et al. |
| 2011/0302929 | A1 | 12/2011 | Bruhwiler |
| 2012/0111023 | A1 | 5/2012 | Sjoqvist et al. |
| 2012/0156020 | A1 | 6/2012 | Kottilingam et al. |
| 2012/0186254 | A1 | 7/2012 | Ito et al. |
| 2012/0204569 | A1 | 8/2012 | Schubert |
| 2013/0011242 | A1 | 1/2013 | Beeck et al. |

FOREIGN PATENT DOCUMENTS

| | | | |
|---|---|---|---|
| WO | WO 2009/157817 | A1 | 12/2009 |
| WO | WO 2010/002295 | A1 | 1/2010 |
| WO | WO 2012/158070 | A1 | 11/2012 |

OTHER PUBLICATIONS

Office Action from European Patent Application No. 13866645.8, dated Mar. 20, 2017, 5 pages.

* cited by examiner

TURBINE EXHAUST CASE MULTI-PIECE FRAME

BACKGROUND

The present disclosure relates generally to gas turbine engines, and more particularly to heat management in a turbine exhaust case of a gas turbine engine.

A turbine exhaust case is a structural frame that supports engine bearing loads while providing a gas path at or near the aft end of a gas turbine engine. Some aeroengines utilize a turbine exhaust case to help mount the gas turbine engine to an aircraft airframe. In industrial applications, a turbine exhaust case is more commonly used to couple gas turbine engines to a power turbine that powers an electrical generator. Industrial turbine exhaust cases may, for instance, be situated between a low pressure engine turbine and a generator power turbine. A turbine exhaust case must bear shaft loads from interior bearings, and must be capable of sustained operation at high temperatures.

Turbine exhaust cases serve two primary purposes: airflow channeling and structural support. Turbine exhaust cases typically comprise structures with inner and outer rings connected by radial struts. The struts and rings often define a core flow path from fore to aft, while simultaneously mechanically supporting shaft bearings situated axially inward of the inner ring. The components of a turbine exhaust case are exposed to very high temperatures along the core flow path. Various approaches and architectures have been employed to handle these high temperatures. Some turbine exhaust case frames utilize high-temperature, high-stress capable materials to both define the core flow path and bear mechanical loads. Other turbine exhaust case architectures separate these two functions, pairing a structural frame for mechanical loads with a high-temperature capable fairing to define the core flow path. Turbine exhaust cases with separate structural frames and flow path fairings pose the technical challenge of installing vane fairings within the structural frame. Fairings are typically constructed as a "ship in a bottle," built piece-by-piece within a unitary frame. Some fairing embodiments, for instance, comprise suction and pressure side pieces of fairing vanes for each frame strut. These pieces are inserted individually inside the structural frame, and joined together (e.g. by welding) to surround frame struts.

SUMMARY

The present disclosure is directed toward a turbine exhaust case comprising a fairing defining an airflow path through the turbine exhaust case, and a multi-piece frame disposed through and around the fairing to support a bearing load. The multi-piece frame comprises an inner ring, an outer ring, and a plurality of strut bosses. The outer ring is disposed concentrically outward of the inner ring, and has open bosses at strut locations. The plurality of radial struts pass through the vane fairing, are secured to the inner ring via radial fasteners, and are secured via non-radial fasteners to the open boss.

DETAILED DESCRIPTION

Figure 1:
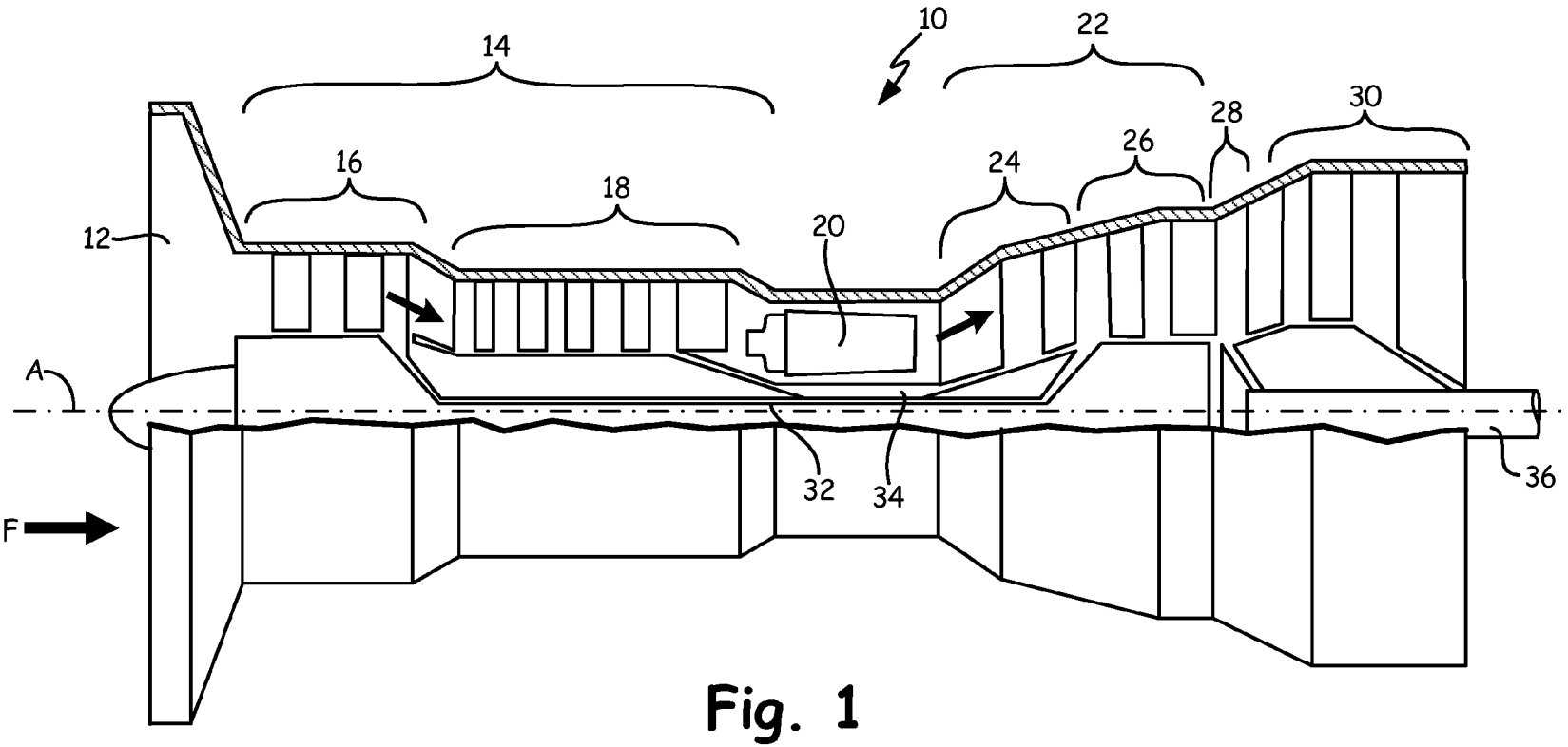
FIG. 1 is a schematic view of a gas turbine generator.

FIG. 1 is a simplified partial cross-sectional view of gas turbine engine 10, comprising inlet 12, compressor 14 (with low pressure compressor 16 and high pressure compressor 18), combustor 20, engine turbine 22 (with high pressure turbine 24 and low pressure turbine 26), turbine exhaust case 28, power turbine 30, low pressure shaft 32, high pressure shaft 34, and power shaft 36. Gas turbine engine 10 can, for instance, be an industrial power turbine.

Low pressure shaft 32, high pressure shaft 34, and power shaft 36 are situated along rotational axis A. In the depicted embodiment, low pressure shaft 32 and high pressure shaft 34 are arranged concentrically, while power shaft 36 is disposed axially aft of low pressure shaft 32 and high pressure shaft 34. Low pressure shaft 32 defines a low pressure spool including low pressure compressor 16 and low pressure turbine 26. High pressure shaft 34 analogously defines a high pressure spool including high pressure compressor 18 and high pressure compressor 24. As is well known in the art of gas turbines, airflow F is received at inlet 12, then pressurized by low pressure compressor 16 and high pressure compressor 18. Fuel is injected at combustor 20, where the resulting fuel-air mixture is ignited. Expanding combustion gasses rotate high pressure turbine 24 and low pressure turbine 26, thereby driving high and low pressure compressors 18 and 16 through high pressure shaft 34 and low pressure shaft 32, respectively. Although compressor 14 and engine turbine 22 are depicted as two-spool components with high and low sections on separate shafts, single spool or three or more spool embodiments of compressor 14 and engine turbine 22 are also possible. Turbine exhaust case 28 carries airflow from low pressure turbine 26 to power turbine 30, where this airflow drives power shaft 36. Power shaft 36 can, for instance, drive an electrical generator, pump, mechanical gearbox, or other accessory (not shown).

In addition to defining an airflow path from low pressure turbine 26 to power turbine 30, turbine exhaust case 28 can support one or more shaft loads. Turbine exhaust case 28 can, for instance, support low pressure shaft 32 via bearing compartments (not shown) disposed to communicate load from low pressure shaft 32 to a structural frame of turbine exhaust case 28.

Figure 2:
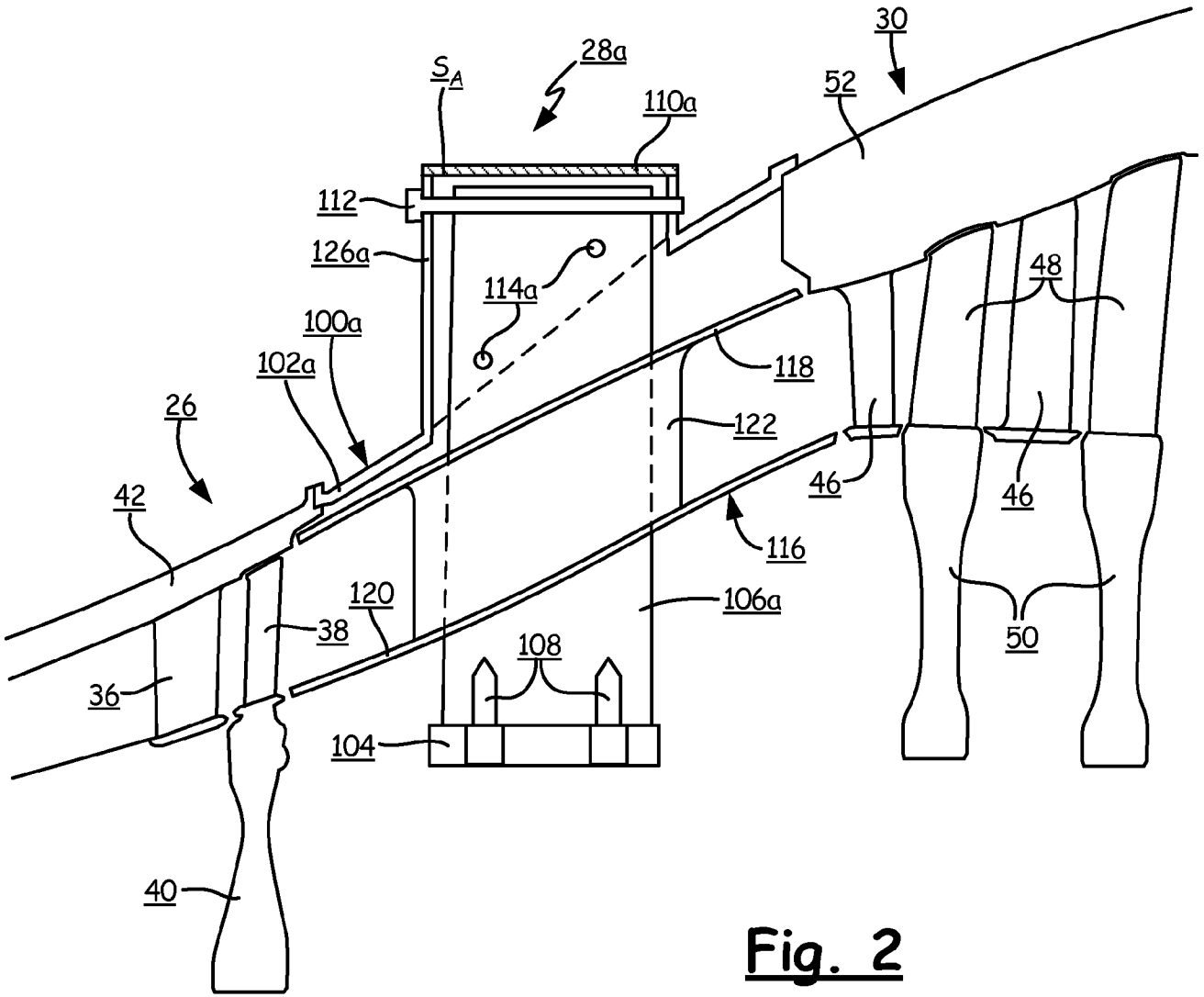
FIG. 2 is a simplified cross-sectional view of a first turbine exhaust case of the gas turbine generator of FIG. 1.

FIG. 2 is a simplified cross-sectional view of one embodiment of turbine exhaust case 28, labeled turbine exhaust case 28*a*. FIG. 2 illustrates low pressure turbine 26 (with low pressure turbine casing 42, low pressure vane 36, low pressure rotor blade 38, and low pressure rotor disk 40) and power turbine 30 (with power turbine case 52, power turbine vanes 46, power turbine rotor blades 48, and power turbine rotor disks 50), and turbine exhaust case 28*a* (with frame 100*a*, outer ring 102*a*, inner ring 104, strut 106*a*, inner radial strut fasteners 108, outer cover 110*a*, chordwise expandable diameter fastener 112, circumferentially-oriented expandable diameter fasteners 114*a*, fairing 116, outer platform 118, inner platform 120, fairing vane 122, and frame boss 126*a*).

As noted above with respect to FIG. 1, low pressure turbine 26 is an engine turbine connected to low pressure compressor 16 via low pressure shaft 32. Low pressure turbine rotor blades 38 are axially stacked collections of circumferentially distributed airfoils anchored to low pressure turbine rotor disk 40. Although only one low pressure turbine rotor disk 40 and a single representative low pressure turbine rotor blade 38 are shown, low pressure turbine 26 may comprise any number of rotor stages interspersed with low pressure rotor vanes 36. Low pressure rotor vanes 36 are airfoil surfaces that channel flow F to impart aerodynamic loads on low pressure rotor blades 38, thereby driving low pressure shaft 32 (see FIG. 1). Low pressure turbine case 42 is a rigid outer surface of low pressure turbine 26 that carries radial and axial load from low pressure turbine components, e.g. to turbine exhaust case 28.

Power turbine 30 parallels low pressure turbine 26, but extracts energy from airflow F to drive a generator, pump, mechanical gearbox, or similar device, rather than to power compressor 14. Like low pressure turbine 26, power turbine 30 operates by channeling airflow through alternating stages of airfoil vanes and blades. Power turbine vanes 46 channel airflow F to rotate power turbine rotor blades 48 on power turbine rotor disks 50.

Turbine exhaust case 28 is an intermediate structure connecting low pressure turbine 26 to power turbine 30. Turbine exhaust case 28 may for instance be anchored to low pressure turbine 26 and power turbine 30 via bolts, pins, rivets, or screws. In some embodiments, turbine exhaust case 28 may serve as an attachment point for installation mounting hardware (e.g. trusses, posts) that supports not only turbine exhaust case 28, but also low pressure turbine 26, power turbine 30, and/or other components of gas turbine engine 10.

Turbine exhaust case 28 comprises two primary components: frame 100, which supports structural loads including shaft loads e.g. from low pressure shaft 32, and fairing 116, which defines an aerodynamic flow path from low pressure turbine 26 to power turbine 30. Fairing 116 can be formed in a unitary, monolithic piece, while frame 100 is assembled about fairing 116.

Outer platform 118 and inner platform 120 of fairing 116 define the inner and outer boundaries of an annular gas flow path from low pressure turbine 26 to power turbine 30. Fairing vane 122 is an aerodynamic vane surface surrounding strut 106*a*. Fairing 116 can have any number of fairing vanes 122 at least equal to the number of struts 106*a*. In one embodiment, fairing 116 has one vane fairing 122 for each strut 106*a* of frame 100. In other embodiments, fairing 116 may include additional vane fairings 122 through which no strut 106*a* passes. Fairing 120 can be formed of a high temperature capable material such as Inconel or another nickel-based superalloy.

Frame 100 is a multi-piece frame comprising three distinct types of structural components, plus connecting fasteners. The outer diameter of frame 100 is formed by outer ring 100*a*, a substantially frustoconical annulus with strut boss 126*a*, a radially outward-extending hollow boss that carries chordwise expandable diameter fasteners 112 and circumferentially-oriented expandable diameter fasteners 114*a* for securing strut 106*a*. Chordwise expandable diameter fasteners 112 and circumferentially-oriented expandable diameter fasteners 114*a* may, for instance, be expandable diameter bolts, shafts, or pins capable of extending entirely through both strut 106*a* and strut boss 126*a*, and expanding to take in corresponding tolerances and account for thermal drift. Chordwise expandable diameter fasteners 112 extend substantially axially through strut boss 126*a* and strut 106*a*, while circumferentially-extending expandable diameter fasteners 114*a* extend circumferentially through strut boss 126*a* and strut 106*a*, and are secured on either angular side of strut boss 126*a*. As depicted in FIG. 1, circumferentially-extending expandable diameter fasteners 114*a* may be situated at more than one radial location with respect to axis A. Strut bosses 126*a* have strut apertures SA at their radially outer extents to receive struts 106*a*. Strut apertures $S_A$ can be sealed by covers 110*a*. As depicted in FIG. 2, cover 110*a* is a flat lid secured over strut aperture $S_A$.

The inner diameter of frame 100 is defined by inner ring 104, a substantially cylindrical structure with inner radial strut fasteners 108. Inner radial strut fasteners 108 may, for instance, be screws, pins, or bolts extending radially inward through inner ring 104 and into strut 106*a* to secure strut 106*a* at its radially inner extent to inner ring 104. In other embodiments, inner radial strut fasteners 108 may be radial posts extending radially inward from inner ring 106*a*, and mating with corresponding post holes at the inner diameter of strut 106*a*. Struts 106*a* are rigid posts extending substantially radially from inner ring 104, through fairing vanes 122, into strut bosses 126*a*. Struts 106*a* are anchored in all dimensions by the combination of chordwise expandable diameter fasteners 112 and circumferentially-oriented expandable diameter fasteners 114*a*. Frame 100 is not directly exposed to core flow F, and therefore can be formed of a material rated to significantly lower temperatures than fairing 120. In some embodiments, frame 100 may be formed of sand-cast steel.

Figure 3:
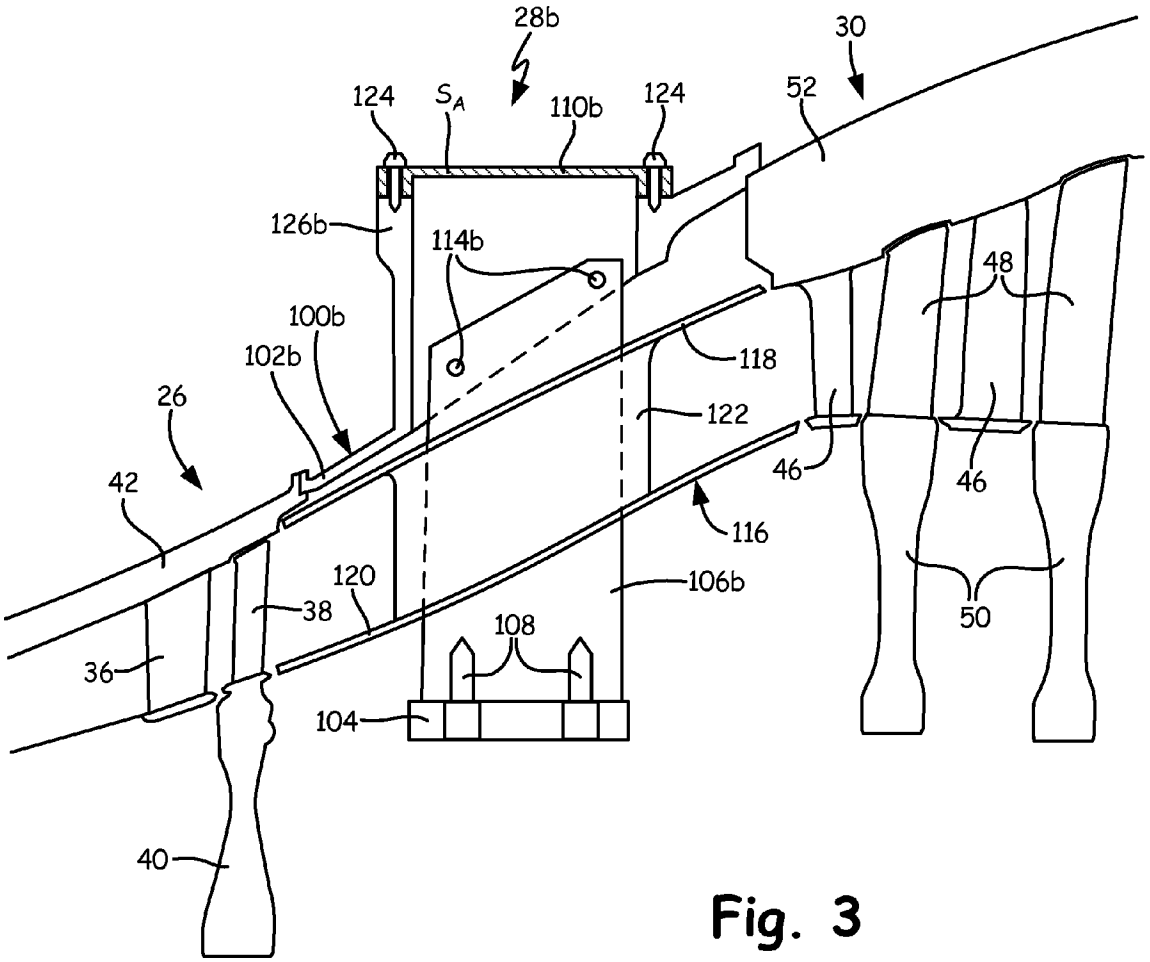
FIG. 3 is a simplified cross-sectional view of an alternative turbine exhaust case to the turbine exhaust case of FIG. 2.

FIG. 3 is a simplified cross-sectional view of an alternative embodiment of turbine exhaust case 28, labeled turbine exhaust case 28*b*. FIG. 2 illustrates low pressure turbine 26 (with low pressure turbine casing 42, low pressure vane 36, low pressure rotor blade 38, and low pressure rotor disk 40) and power turbine 30 (with power turbine case 52, power turbine vanes 46, power turbine rotor blades 48, and power turbine rotor disks 50), and turbine exhaust case 28*b* (with frame 100*b*, outer ring 102*b*, inner ring 104, strut 106*b*, inner radial strut fasteners 108, outer cover 110*b*, circumferentially-oriented expandable diameter fasteners 114*b*, fairing 116, outer platform 118, inner platform 120, fairing vane 122, and cover fasteners 124, and strut boss 126*b*). Turbine exhaust case 28*b* differs from turbine exhaust case 28*a* only in frame 100*b*, outer ring 102*b*, cover 110*b*, circumferentially-oriented expandable diameter fasteners 114*b*, and cover fasteners 124; in every other way the embodiments depicted in FIGS. 2 and 3 are identical. Frame 100*b* differs from frame 100*a* in that strut boss 126*b* includes no apertures for chordwise expandable diameter fasteners. Strut 114*b* is secured solely by circumferentially-extending expandable diameter fasteners 114*b* in strut boss 126*b*, and need extend as far radially as strut 106*a*. Cover 110*b* is a sealing plate secured in an airtight seal over strut aperture $S_A$ by cover fasteners 124, which may for instance be bolts, pins, rivets, or screws.

Turbine exhaust case 28 is assembled by axially and circumferentially aligning fairing 120 with inner ring 104 and outer ring 102, and slotting each strut 106 through strut aperture $S_A$ and fairing vane 126 from radially outside onto inner radial strut fasteners 108. In some embodiments (e.g. where inner radial strut fasteners are screws or bolts) inner radial strut fasteners 108 can then be secured to the inner diameter of strut 106. Circumferentially-oriented expandable diameter fasteners 114 (and chordwise expandable diameter fasteners 112, in the embodiment of FIG. 2) are next slotted through corresponding holes in strut 114*a* and strut boss 126, tightened, and expanded to lock strut 106 to outer ring 102. The multi-piece construction of frame 100 allows turbine exhaust case 28 to be assembled around fairing 120. Accordingly, fairing 120 can be a single, monolithically formed piece, e.g. a unitary die-cast body with no weak points corresponding to weld or other joint locations.

DISCUSSION OF POSSIBLE EMBODIMENTS

The following are non-exclusive descriptions of possible embodiments of the present invention.

A turbine exhaust case comprises a turbine exhaust case comprising a fairing defining and airflow path through the turbine exhaust case, and a multi-piece frame disposed through and around the fairing to support a bearing load. The multi-piece frame comprises an inner ring, an outer ring, and a plurality of strut bosses. The outer ring is disposed concentrically outward of the inner ring, and has open bosses at strut locations. The plurality of radial struts pass through the vane fairing, are secured to the inner ring via radial fasteners, and are secured via non-radial fasteners to the open boss.

The turbine exhaust case of the preceding paragraph can optionally include, additionally and/or alternatively, any one or more of the following features, configurations, and/or additional components:

wherein the multi-piece frame is formed of steel.

wherein the multi-piece frame is formed of sand-cast steel.

wherein the fairing is monolithically formed.

wherein the fairing is formed of a material rated for a higher temperature than the multi-piece frame.

wherein the fairing is formed of a nickel-based superalloy.

further comprising airtight sealing plates covering each open boss.

wherein the non-radial fasteners comprise a circumferentially-oriented expandable diameter fastener.

wherein the non-radial fasteners further comprise at least one chordwise-oriented expandable diameter fastener.

wherein the radial fasteners comprise radial bolts extending through the inner ring and into the radial struts.

A turbine exhaust case comprising an inner cylindrical ring; an outer frustoconical ring with a plurality of angularly distributed hollow strut bosses; and a plurality of radial struts secured to the inner cylindrical ring via radial fasteners, and to the angularly distributed hollow strut bosses via non-radial expandable diameter fasteners.

The turbine exhaust case frame of the preceding paragraph can optionally include, additionally and/or alternatively, any one or more of the following features, configurations, and/or additional components:

wherein the radial fasteners are bolts, pins, or screws extending radially through the inner cylindrical ring and into the radial struts.

wherein the inner non-radial expandable diameter fasteners comprise a circumferentially-oriented expandable diameter fastener.

wherein the inner non-radial expandable diameter fasteners comprise a chordwise-oriented expandable diameter fastener.

further comprising a sealing plate providing an air seal over the outer radial extent of the hollow strut bosses.

A method of assembling a turbine exhaust case, the method comprising: aligning fairing vanes of a flow path defining fairing, radial fasteners on an inner frame ring, and strut apertures in a strut boss of an outer frustoconical ring; inserting a radial strut from radially outside the outer frustoconical ring, through the strut aperture and the fairing vane; securing the radial strut to the inner frame ring via the radial fasteners; and securing the radial strut to the strut boss via non-radial expandable diameter fasteners.

The method of the preceding paragraph can optionally include, additionally and/or alternatively, any one or more of the following features, configurations, and/or additional components:

further comprising covering the sealing aperture with an airtight sealing plate.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine exhaust case comprising:

a fairing defining and airflow path through the turbine exhaust case; and a multi-piece frame disposed through and around the fairing to support a bearing load, the multi-piece frame comprising:

a inner ring;

an outer ring disposed concentrically outward of the inner ring, and having open bosses at strut locations; and a plurality of radial struts passing through the vane fairing, secured to the inner ring via radial fasteners, and secured via non-radial fasteners to the open boss;

wherein the radial fasteners are pins or posts extending through the inner ring and into the radial struts, and wherein the radial struts are retained in engagement with the radial fasteners by attachment of the non-radial fasteners.

2. The gas turbine exhaust case of claim 1, wherein the multi-piece frame is formed of steel.

3. The gas turbine exhaust case of claim 2, wherein the multi-piece frame is formed of sand-cast steel.

4. The gas turbine exhaust case of claim 1, wherein the fairing is monolithically formed.

5. The gas turbine exhaust case of claim 1, wherein the fairing is formed of a material rated for a higher temperature than the multi-piece frame.

6. The gas turbine exhaust case of claim 1, wherein the fairing is formed of a nickel-based superalloy.

7. The gas turbine exhaust case of claim 1, further comprising airtight sealing plates covering each open boss.

8. The gas turbine exhaust case of claim 1, wherein the non-radial fasteners comprise a circumferentially-oriented expandable diameter fastener.

9. The gas turbine exhaust case of claim 8, wherein the non-radial fasteners further comprise at least one chordwise-oriented expandable diameter fastener.

10. A turbine exhaust case frame comprising:

an inner cylindrical ring;

an outer frustoconical ring with a plurality of angularly distributed hollow strut bosses; and a plurality of radial struts secured to the inner cylindrical ring via radial fasteners, and to the angularly distributed hollow strut bosses via non-radial expandable diameter fasteners;

wherein the radial fasteners are pins or posts extending radially through the inner cylindrical ring and into the radial struts, and wherein the radial struts are retained in engagement with the radial fasteners by attachment of the non-radial expandable diameter fasteners.

11. The turbine exhaust case frame of claim 10, wherein the inner non-radial expandable diameter fasteners comprise a circumferentially-oriented expandable diameter fastener.

12. The turbine exhaust case frame of claim 10, wherein the inner non-radial expandable diameter fasteners comprise a chordwise-oriented expandable diameter fastener.

13. The turbine exhaust case frame of claim 10, further comprising a sealing plate providing an air seal over the outer radial extent of the hollow strut bosses.

14. A method of assembling a turbine exhaust case, the method comprising:

aligning fairing vanes of a flow path defining fairing, radial fasteners on an inner frame ring, and strut apertures in a strut boss of an outer frustoconical ring;

inserting a radial strut from radially outside the outer frustoconical ring, through the strut aperture and the fairing vane;

securing the radial strut to the inner frame ring via the radial fasteners, the radial fasteners being pins or posts; and securing the radial strut to the radial fasteners and to the strut boss via non-radial expandable diameter fasteners.

15. The method of claim 14, further comprising covering the sealing aperture with an airtight sealing plate.

* * * * *